United States Patent [19]

Long et al.

[11] Patent Number: 4,684,192

[45] Date of Patent: Aug. 4, 1987

[54] BREAKAWAY ELECTRICAL CONNECTOR

[75] Inventors: William B. Long, Camp Hill; Gary L. Over, Harrisburg; Howard R. Shaffer, Millersburg; John R. Shuey, Mechanicsburg, all of Pa.

[73] Assignee: AMP Incorporated, Harrisburg, Pa.

[21] Appl. No.: 908,753

[22] Filed: Sep. 18, 1986

[51] Int. Cl.[4] ..... H01R 13/20

[52] U.S. Cl. ..... 439/374; 439/296; 439/152; 439/350

[58] Field of Search ..... 339/75 R, , 75 M, 75 P, 339/91 R, 45, 46, 75 MP, 64, 65, 66

[56] References Cited

U.S. PATENT DOCUMENTS

| | | | |
|---|---|---|---|
| 2,853,690 | 9/1958 | Madison | 339/45 R |
| 3,111,355 | 11/1963 | Samburoff et al. | 339/45 M |
| 3,529,276 | 9/1970 | Hennessey, Jr. | 339/45 R |
| 4,332,432 | 6/1982 | Colleran | 339/75 M |
| 4,468,075 | 8/1984 | Tamura et al. | 339/75 M |
| 4,548,455 | 10/1985 | Ezure | 339/45 M |
| 4,647,130 | 3/1987 | Blair et al. | 339/64 M |

*Primary Examiner*—Gil Weidenfeld
*Assistant Examiner*—David Pirlot
*Attorney, Agent, or Firm*—Anton P. Ness

[57] ABSTRACT

A shielded breakaway connector assembly has mating polarized conductive shells and mating respective dielectric inserts mounted therein having mating terminals therein. A plug insert is mounted in its shell permitting limited axially normal movement in a selected direction against spring bias so that during mating said plug insert is cammed in that direction by a cam member secured to the receptacle insert's shell to achieve a tentative mating condition wherein the respective contact sections engage and electrically connect. Full mating is achieved when the plug insert is further pushed against the receptacle insert in order for a latch surface of the plug to latch behind a cooperating latch on the cam member which latches are adapted to be delatchable solely when limited tensile force pulls the plug insert away from the receptacle insert's shell to overcome the axially normal spring bias on the plug insert and the resistance to delatching of the latches. The mating contact sections engage under substantial contact normal force by contact arms of the receptacle's terminals being laterally deflected by the plug's terminals when the plug insert is cammed laterally.

25 Claims, 22 Drawing Figures

176
172
174
170
122
128
120
134
130
194
190
196
126
150
148
162
192
160
204
144
146
140
142
202
110
114
168

BREAKAWAY ELECTRICAL CONNECTOR

FIELD OF THE INVENTION

This relates to the field of electrical connectors and more particularly to mating and latching systems therefor.

BACKGROUND OF THE INVENTION

Electrical connector assemblies of plug and receptacle connectors are known with a variety of latching mechanisms some of which require appropriate tools to delatch and others which require at least manipulation to delatch, for unmating of the connector assembly as desired. There are also connector assemblies of plug and receptacle connectors wherein inserts are secured in shells and are held in mated engagement by a threaded coupling ring securing the shells together.

Certain connector applications would make it desirable for the mated connectors to be unmatable solely by pulling the connectors apart with a certain level of tensile force, without tools and without manipulation such as rotating a coupling ring, unscrewing a fastener, lifting or depressing a latch arm or withdrawing a lock insert. Such applications would include both prevention of apparatus damage due to inadvertent stress on the connector assembly mounted thereto, and allowance of separation of mated connectors in an emergency. An example of the former would be a portable keyboard of a computer terminal movable with respect to the terminal, where the connector cord of limited length between keyboard and terminal is accidentally pulled. An example of the latter would be in an aircraft where the pilot's helmet has an electrical connection to the aircraft, and an emergency necessitates sudden ejection of the pilot and there is no time nor opportunity available for the pilot to attend to disconnecting the connectors. Pilot helmets are presently being designed with features requiring a plurality of electrical connections for a variety of reasons, such as stereo transmission of a pilot's voice via microphone and stereo sound transmission to him or her earphones. Another new requirement is audio pickup of continuous low frequency noise at the helmet for feedback to a white noise generator. Such multiple electrical connections cannot be handled by conventional phone plugs having only two or three contact members, even though such plugs are unmatable from their receptacles by a certain amount of axial tensile force.

U.S. Pat. No. 4,647,130, discloses a drawer connector requiring blind mating which is a high durability connector. The mating contact array provides for high contact normal force between the matable pairs only by relative lateral movement of the connectors, and provides for minimal frictional engagement between the matable pairs. At least one of the mating connectors is float mounted to its panel, and lateral movement is obtained when the connectors are aligned and almost fully together, by corresponding camming surfaces on the mating housings engaging to urge the float mounted housing in a selected axially normal direction, which movement causes the contact sections of one connector to deflect the contact arms of the other connector against spring bias, thereby achieving substantial normal force therebetween for assured electrically mating engagement.

It is desirable to provide a connector assembly which is delatchable solely by application of a certain level of axial tensile force thereto.

It is further desirable to provide such a delatchable connector assembly with mating contact arrays which have minimal frictional engagement through many mating cycles for long in-service utility.

It is still further desirable to provide a connector assembly with contact-containing inserts in shells which connectors are matable and latchable solely under axially applied force when mating must necessarily occur prior to latching, and where a mating but unlatched condition is preempted.

It is yet further desirable to provide such a connector assembly as described above which has conductive shells designed to substantially eliminate electromagnetic interference.

SUMMARY OF THE INVENTION

The present invention comprises an assembly of a first connector and a second connector which are capable of being pulled apart by limited axial tensile force only, without tools or manipulation. A first multi-terminal insert secured in a first shell comprises the first connector, and the insert is of the receptacle type and is mounted therein to be moved axially rearwardly a short distance against spring bias during mating. A second multi-terminal insert secured in a second shell comprises the second connector, and the insert is of the plug type and is mounted therein to be movable in a selected axially normal direction during mating against spring bias.

According to one aspect of the invention, a passive cam is secured within the shell of the first connector which comprises a tapered bearing or camming surface engaged by a bearing means of the insert of the second connector during axial mating to urge the second connector's insert in the selected axially normal direction to arrive at a tentative mating engagement with the insert of the first connector. Then when the second insert is pushed further axially against the first insert urging the first insert rearwardly with respect to its shell, latching of a latch projection of the second insert with respect to a latch projection of the first shell achieves a full mating engagement.

The latching projections of the second insert and first shell are adapted to provide limited resistance to delatching, where delatching occurs upon merely the application of a selected limited axial tensile force which must be sufficient to overcome the limited resistance to delatching and the spring bias resisting movement of the second insert with respect to its shell, in the selected axially normal direction. The cam can be a rigid arm secured within the first shell rearward of the first insert and extending forwardly through a slot of the first insert and along a selected wall of the receptacle cavity. The latching ridge at the rear of the tapered bearing surface of the cam has an angled rearwardly facing ledge comprising a latching surface, engageable by a corresponding rearwardly facing latching surface of the second insert's latching projection. The second insert's latching projection can include the bearing means in the form of a rounded bearing surface portion engageable with the cam's bearing surface during mating.

According to another aspect of the invention, the tentative mating engagement is achieved in the following manner. Pairs of lateral bosses extend outwardly from two opposing sides of the second insert at the forward end thereof, and are associated with corresponding pairs of channels along inside surfaces of the receptacle section of the first insert. When the second insert approaches the first insert, the lateral bosses enter the channels and move axially therealong. Contact sections of the terminals of the first insert comprise cantilever spring arms extending forwardly within the receptacle section of the first insert, and enter corresponding passageways of the second insert alongside of corresponding contact sections of terminals in the second insert. When the first insert's contact arms have entered the passageways an appropriate distance, the second insert's lateral bosses are aligned with axially normal portions of the channels. The bearing means of the second insert now engages the cam of the first shell and the second insert is urged in the selected axially normal direction, such that the second insert's terminals engage the first insert's contact arms and deflect them in the selected axially normal direction under substantial contact normal force, and the second insert's lateral bosses enter the axially normal channel portions.

According to still another aspect of the invention, the first and second shells are metallic or are metallized plastic for EMI shielding, with the forward edge of the second shell received into the first shell around the receptacle section of the first insert. Engagement between the shells is accomplished by a plurality of short spring fingers secured to and extending inwardly from the forward edge of the first shell to establish mechanical and grounding engagement with outside surfaces of the second shell; the spring fingers can be integral with a metal strip secured to the first shell around the outside periphery of the forward edge thereof. The shells can be electrically connected to the shielding braid of the respective conductor cables by tapered crimping sleeves urged by a threaded retaining nut into rearward ends of correspondingly tapered bores of the respective shells, pinning the braids between the sleeves and bores.

It is an objective of the present invention to provide a mated connector assembly which is instantaneously delatchable and unmatable solely by application of a selected limited axial tensile force to the mated connectors, such as six to ten pounds.

It is another objective of the present invention to provide a nonstubbing wear resistant mating contact arrangement by passive lateral camming action, and to latch the mating connectors only after the contacts are fully electrically engaged under full contact normal force.

It is still another objective to provide a breakaway connector assembly with the mating and latching arrangement set forth above with high integrity EMI shielding.

DETAILED DESCRIPTION OF THE PREFERRED EMBODIMENT

Figure 1:
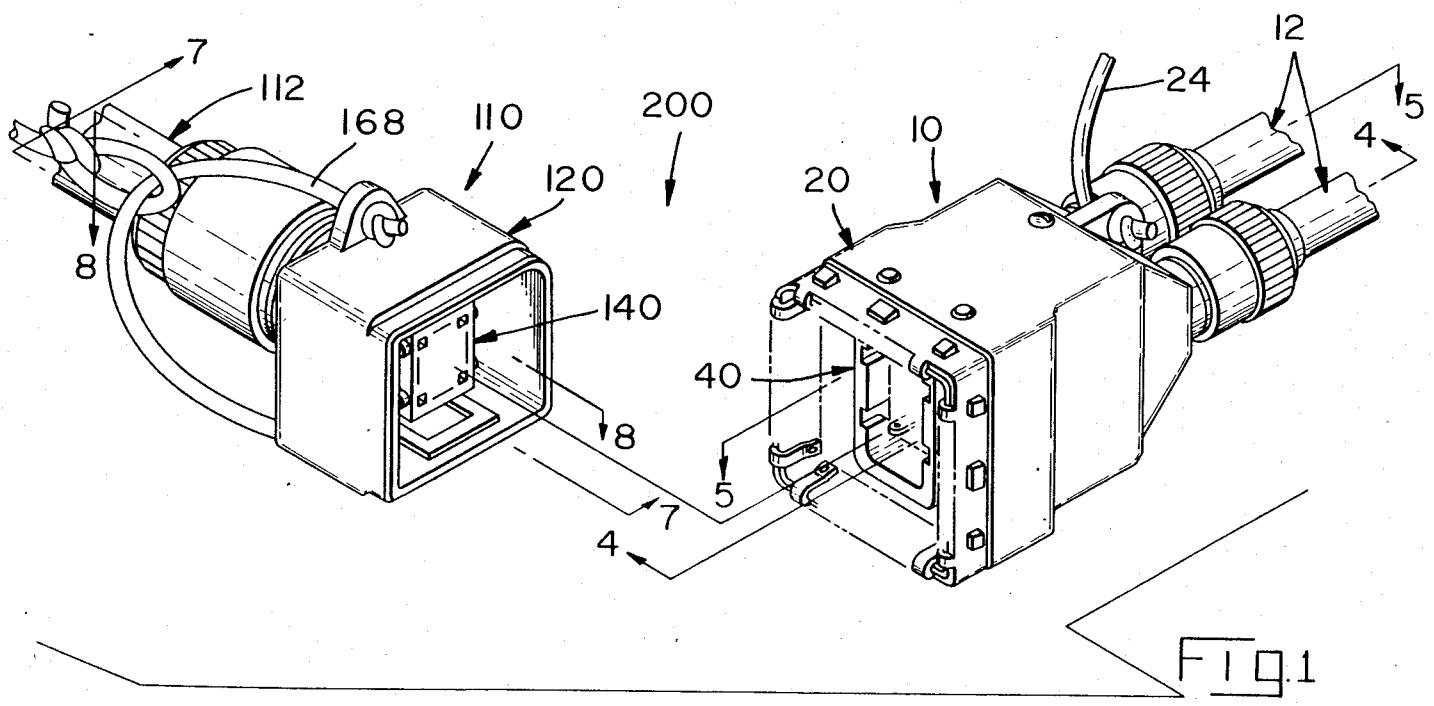
FIG. 1 illustrates the mating first and second connectors of the present invention.

FIG. 1 illustrates a first or receptacle connector 10 and a second or plug connector 110 which are matable to form a connector assembly 200. These embodiments of connectors 10,110 protect against electromagnetic interference (EMI) and are usable for example in aircraft to provide an electrical connection between a pilot's helmet and the aircraft. With connector 110 secured to the aircraft such as by lanyard 168, connector 10 is preferably secured to the pilot's uniform by a lanyard 24 and is delatchable from connector 110 when pulled, to disconnect without tools or manipulation to facilitate ejection of the pilot should an emergency arise. Connectors 10,110 electrically connect a plurality of terminated conductors of shielded cables 12,12,112.

Figure 2:
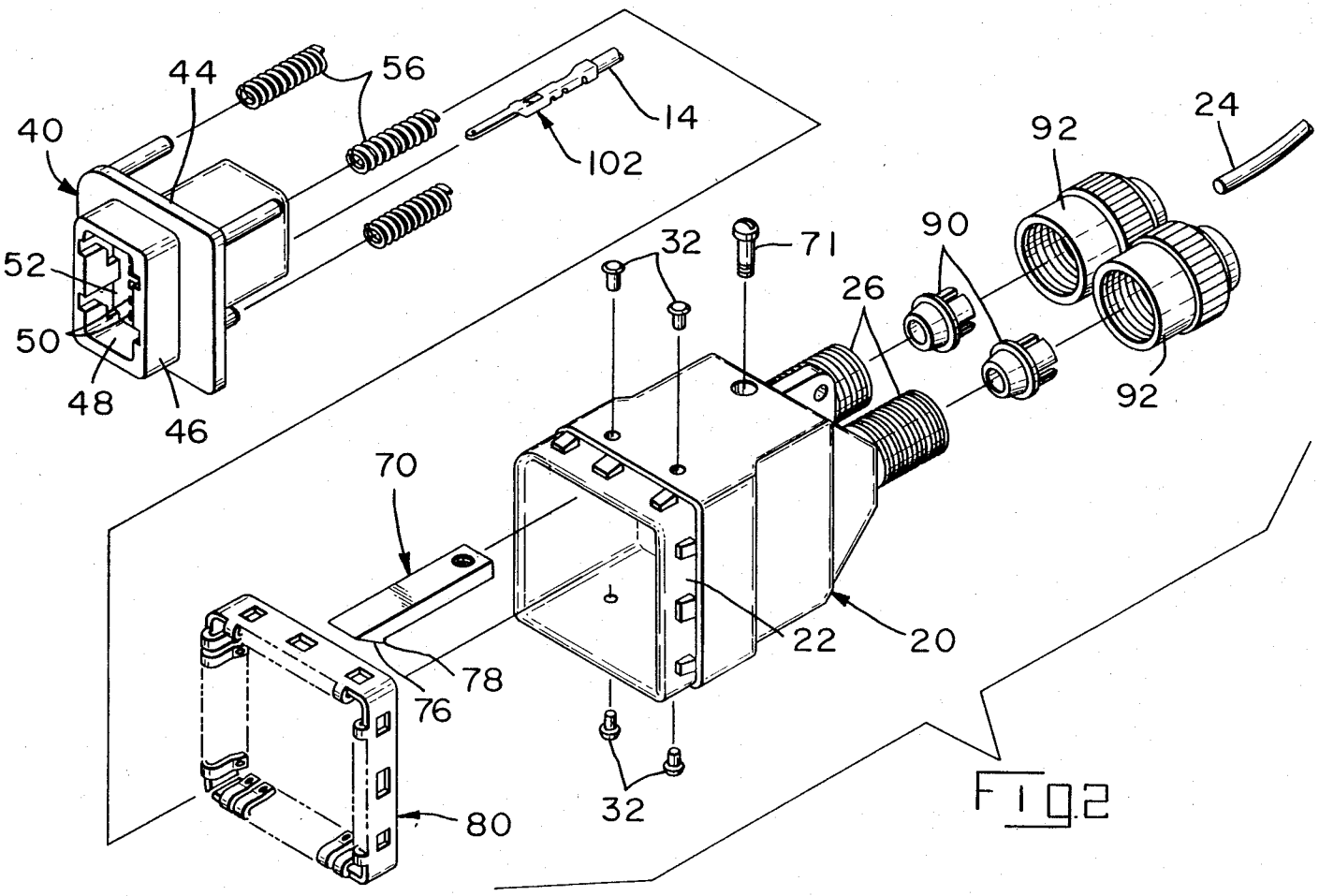
FIG. 2 is an explosed perspective view of the first connector of FIG. 1.

In FIG. 2, first or receptacle connector 10 comprises basically a conductive first shell 20 in which is securable a dielectric first or receptacle insert 40. An EMI contact member 80 is securable to recessed forward end 22 of shell 20. A cam arm 70 is securable to shell 20 therewithin such as by a screw 71. Receptacle insert 40 includes body section 42, flange 44, and receptacle section 46 forwardly of flange 44 including a plug-receiving cavity 48. A plurality of terminal receiving passageways 50 extends rearwardly from mating face 52 through body section 42 to receive respective first terminals 102 which are terminated to conductors 14 of cables 12. Extending rearwardly from flange 44 are guide pins 54 around which are disposed coil compression springs 56. Cable sleeves 90 and retaining nuts 92 are securable to cable receiving sections 26 of shell 20 when the respective cables are connected to connector 10. Shell 20 also has polarizing means such as larger radiussed corner 98.

Figure 3:
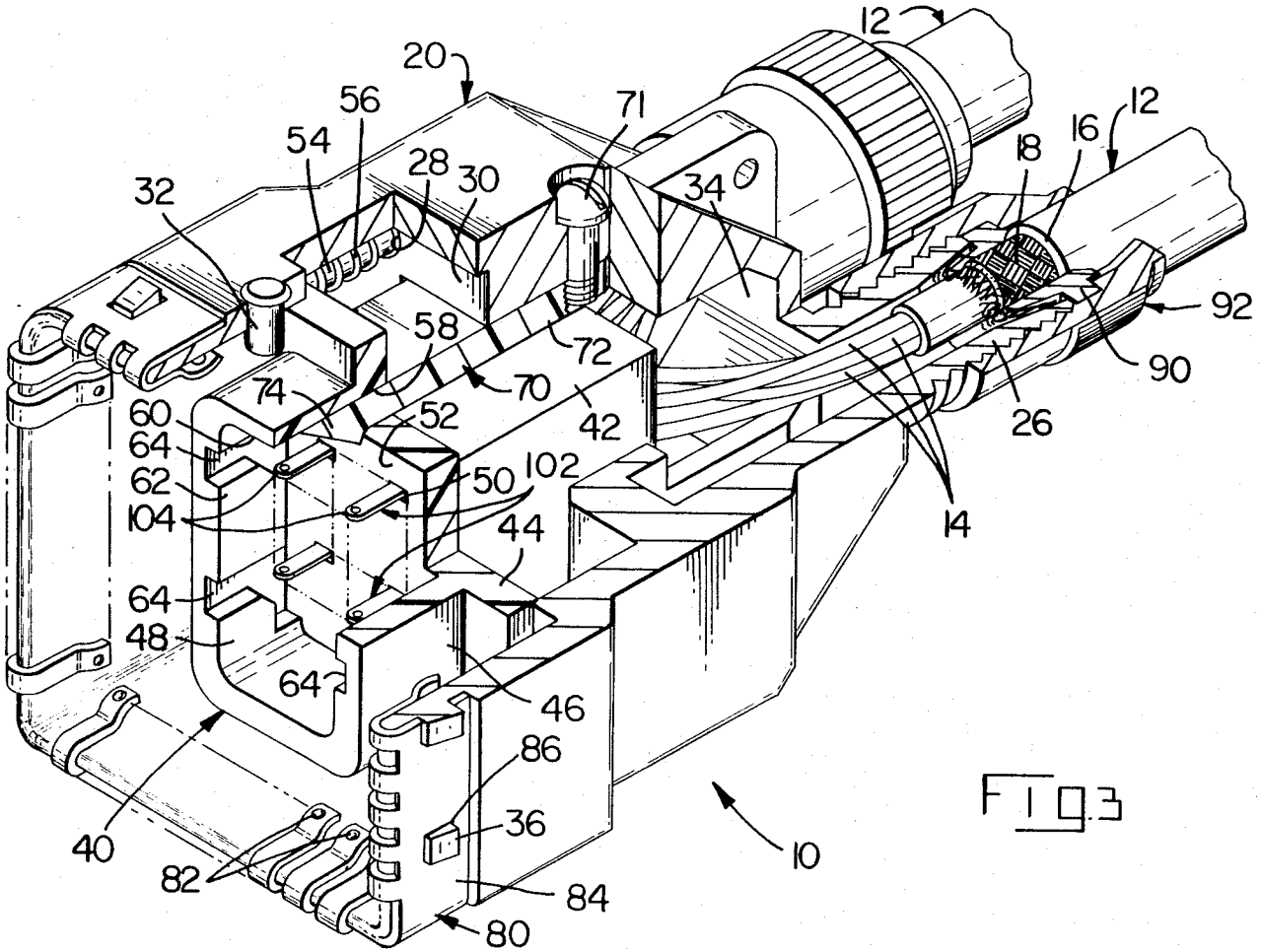
FIG. 3 is a part perspective part longitudinal section view of the first connector of FIG. 1.
Figure 4:
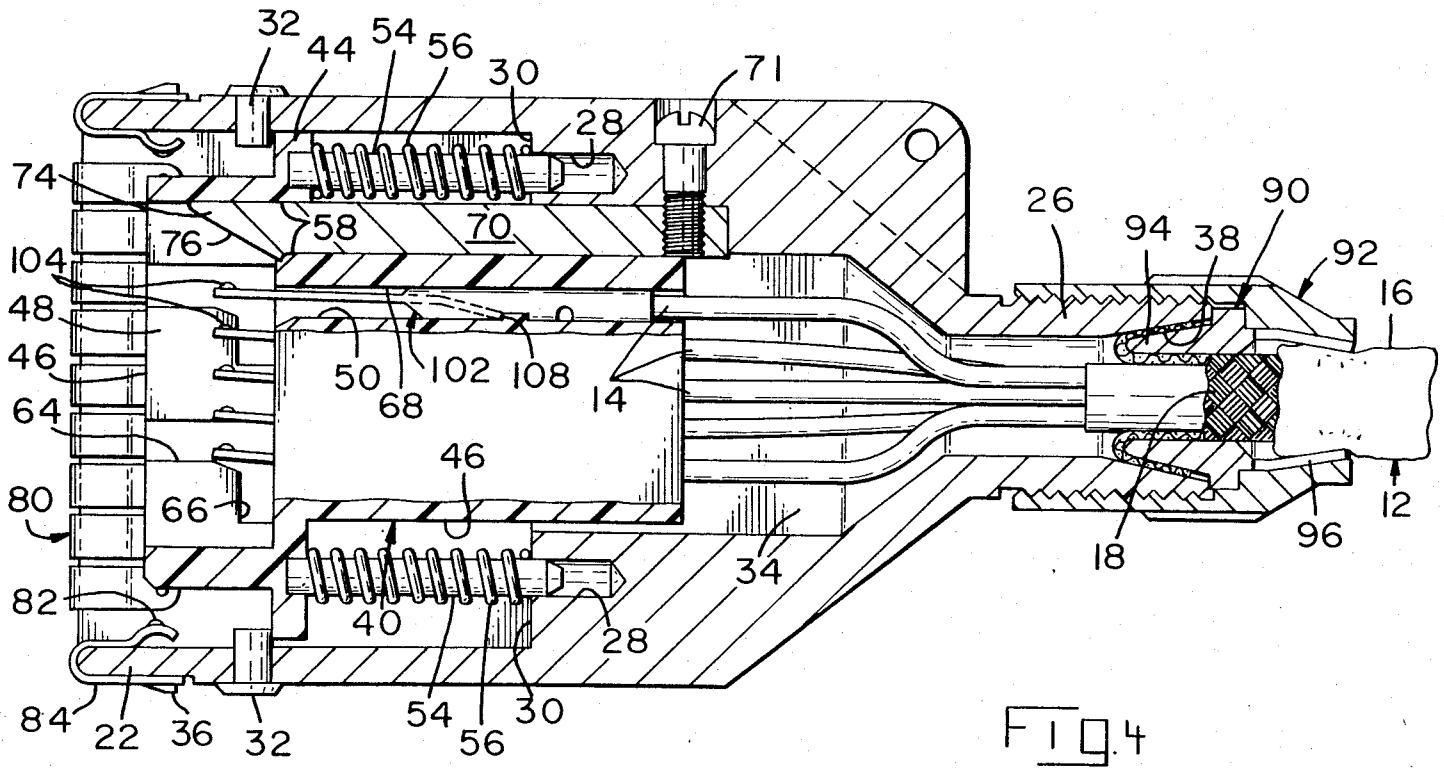
FIGS. 4 and 5 are elevation and top longitudinal section views of the first connector taken along lines 4—4 and 5—5 of FIG. 1 respectively.
Figure 5:
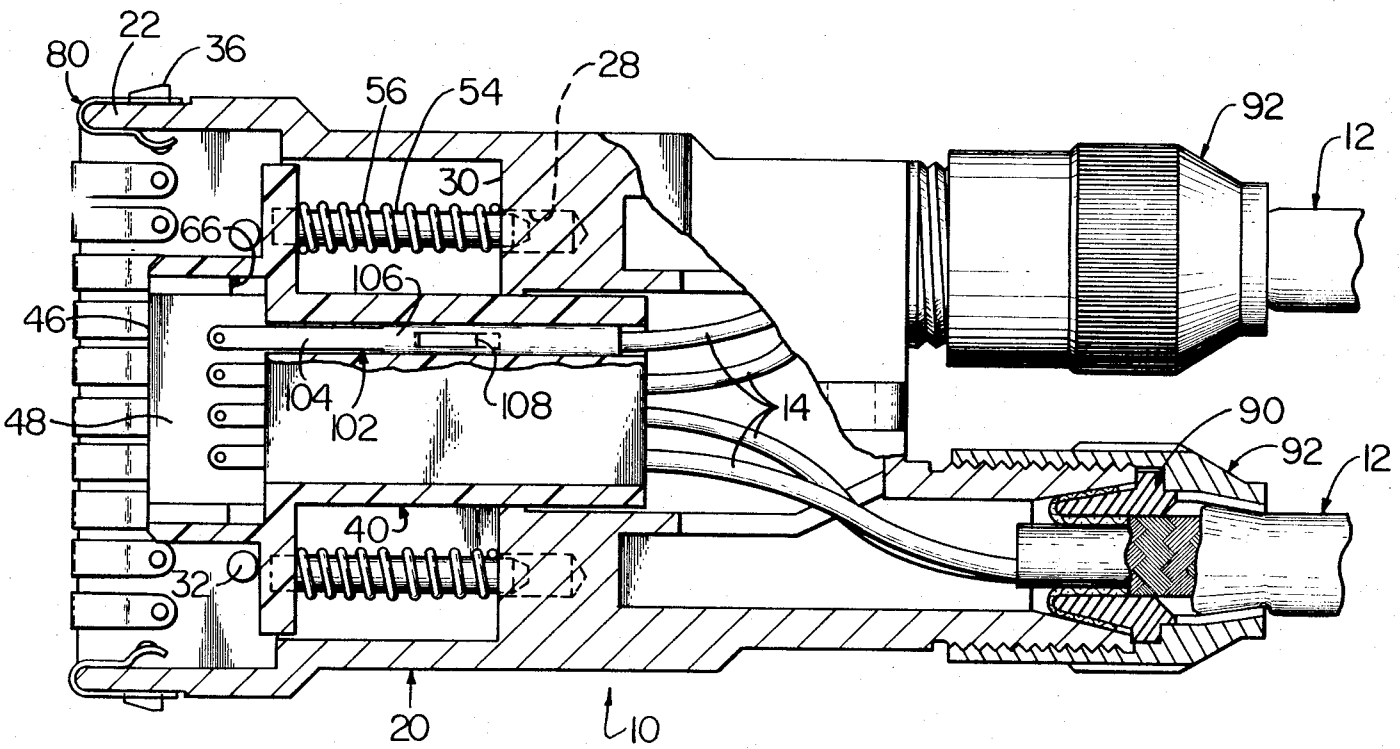

FIGS. 3 to 5 show the various parts of assembled first connector 10 in detail. Terminals 102 terminated to conductors 14 of cables 12 have been secured in respective passageways 50 of receptacle insert 40 such that the contact sections comprised of contact arms 104 extend forwardly of mating face 52 within plug-receiving cavity 48. Best shown in FIGS. 4 and 5, receptacle insert 40 is mounted within first shell 20 with guide pins 54 extending rearwardly into axial guide holes 28 in shoulder 30 of shell 20; an axial spring means comprises compression springs 56 around guide pins 54 which springs 56 are of a diameter larger than that of guide holes 28 to be compressible between shoulder 30 and flange 44 of receptacle insert 40 upon axially rearward movement of receptacle insert 40. Stops such as rivets 32 are secured to first shell 20 such that flange 44 is held therebehind with insert 40 under spring bias from springs 56. Axial rearward movement of insert 40 is permitted by the distance between flange 44 and shoulder 28 and the existence of relief area 34 behind body section 42; and relief area 34 also permits resultant flexing of conductors 14. The rearward end 72 of cam arm 70 is secured to shell 20 such as by screw 71, and front end 74 extends forwardly through slot 58 of insert 40 into plug-receiving cavity 48 along the inside surface of upper cavity wall 60 just past mating face 52.

Cavity sidewalls 62 include opposing channels 64 extending axially rearwardly from the front of receptacle insert 40 and include axially normal channel portions 66 near mating face 52 extending away from upper cavity wall 60 and cam front end 74.

EMI contact member 80 comprises a plurality of spring fingers 82 extending forwardly from contact body section 84 and are doubled back along the inside surface thereof; body section 84 is secured to the outside periphery of recessed forward shell end 22 such as by locking projections 36 of shell 20 extending outwardly through apertures 86 and the seam of stamped and formed EMI contact member 80 then preferably being welded, with spring fingers 82 extending axially rearwardly along the inside surface of forward shell end 22.

Outer jacket 16 of each cable 12 has been removed to expose a length of shielding braid 18, which has been partially unraveled and doubled back over and around forward tapered end 94 of each sleeve 90, which has been urged forwardly and into correspondingly tapered bore 38 of cable receiving section 26 of shell 20, mechanically securing and electrically engaging braid 18 to shell 20. Each retaining nut 92 has been threaded onto correspondingly threaded cable securing section 26 urging sleeve 90 into bore 38 and also deflecting slotted strain relief section 96 firmly against and into outer jacket 16 of cable 12. This provides both cable strain relief and grounding engagement between shell 20 and cable braid 18 in a strain relief assembly which also provides assured EMI shielding at the rear of first connector 10.

In the preferred embodiment of terminals 102, contact arms 104 extend forwardly from respective passageways 50 near upper walls 68 thereof proximate cam arm front end 72 and comprise cantilever arms which are deflectable downwardly about point 106 for a limited axially normal distance, best shown in FIG. 4. Contact terminals 102 are secured in passageways 50 against axial movement such as by stops 108.

Figure 6:
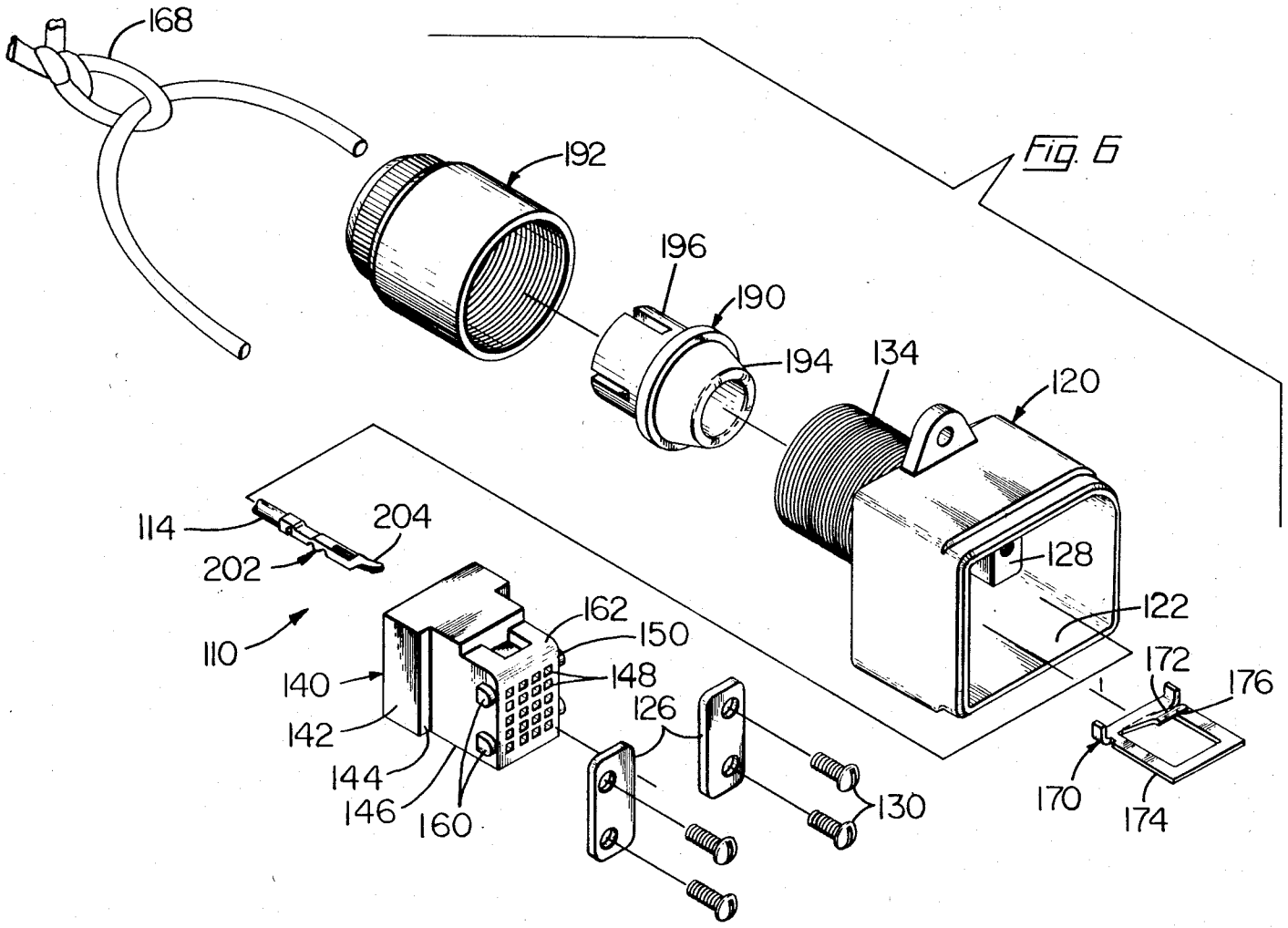
FIG. 6 is an explosed perspective view of the second connector of FIG. 1.
Figure 7:
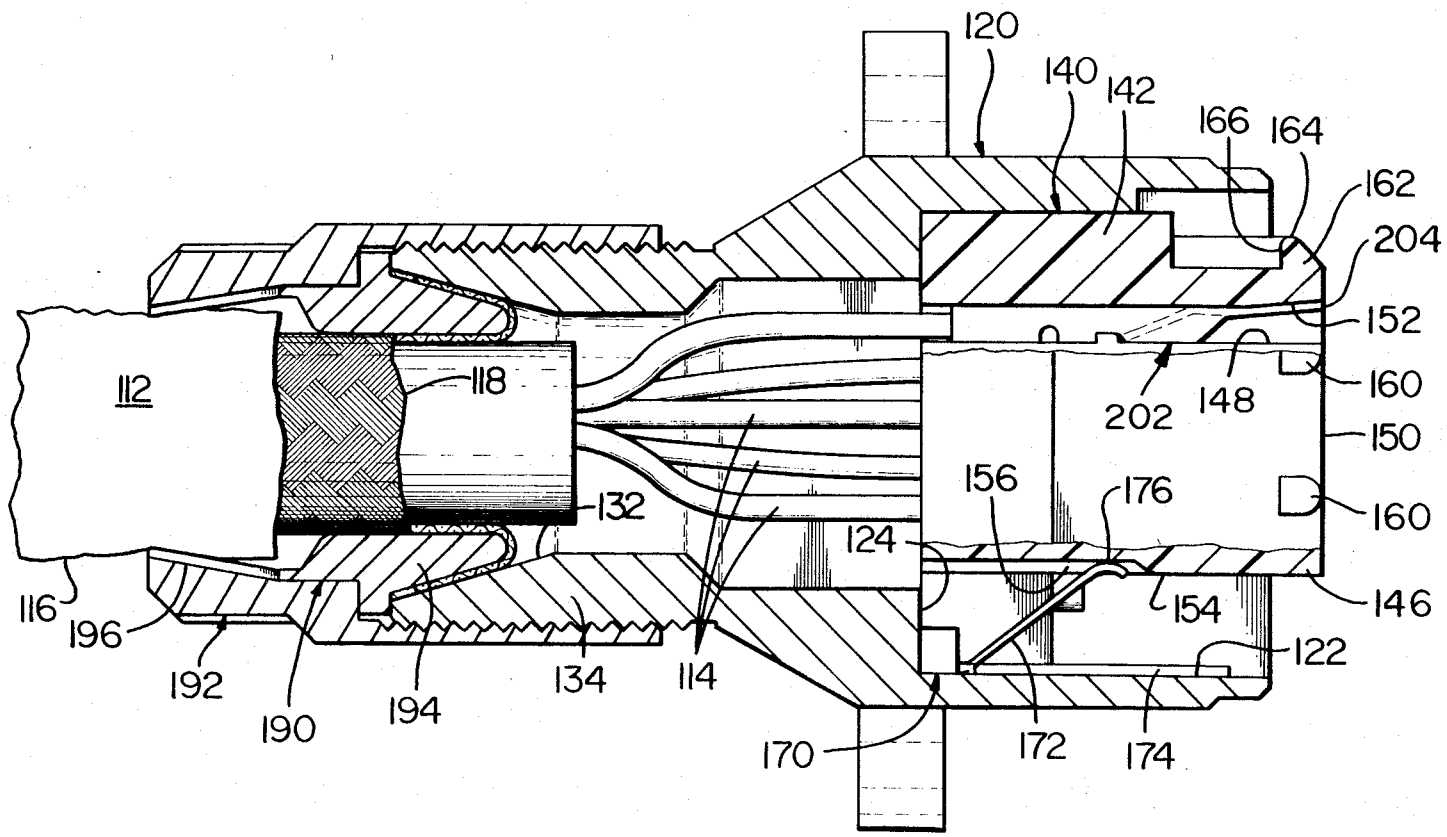
FIGS. 7 and 8 are elevation and top longitudinal section views of the second connector taken along lines 7—7 and 8—8 of FIG. 1 respectively.
Figure 8:
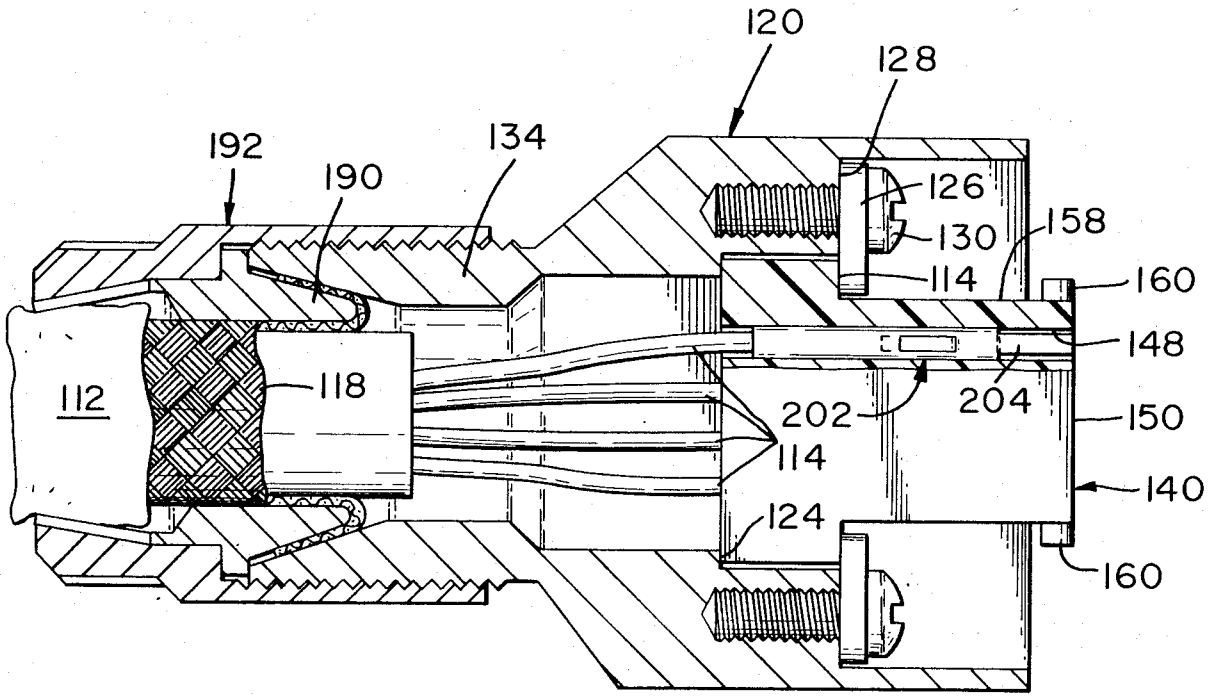

Referring now to FIGS. 6 to 8, second or plug connector 110 comprises basically a conductive second shell 120 in which is securable a dielectric second or plug insert 140. Connector 110 is preferably secured to a bulkhead of the aircraft by a lanyard 168 to allow movement to accommodate movement of the pilot and also to permit straight out disconnecting of connector 10 therefrom in a range of possible directions. Shell 120 has a corresponding polarizing means such as larger radiussed corner 198. Plug insert 140 includes a body section 142 having vertical forwardly facing mounting shoulders 144, and a plug section 146 at the forward end of insert 140. A plurality of terminal receiving passageways 148 extends rearwardly from mating face 150 through body section 142 to receive respective terminals 202 which are terminated to conductors 114 of cable 112. Contact sections 204 of terminals 202 are disposed within passageways 148 and against upper walls 152 thereof, slightly tapered as lead-ins.

Spring member 170 is disposed within second shell 120 below plug insert 140 and may be secured thereat such as by being welded to the inside bottom surface 122 of second shell 120. A normal spring means comprises spring member 170 which has a cantilever spring arm 172 extending upwardly and forwardly from a rear portion of spring body section 174 to engage bottom surface 154 of plug insert 140 and preferably within a shallow recess 156 therein. Spring arm 172 is deflectable downwardly by plug insert 140 upon downward movement thereof, and free end 176 is arcuate to move without stubbing along surface 154 within recess 156 and preferably guided by the sides of the recess.

Plug insert 140 is secured in second shell 120 above spring member 170 and against rear stop surface 124, by mounting plates 126 being fastened to shell lands 128 such as by screws 130. Plates 126 extend laterally inwardly toward sides 158 of plug insert 140 in front of and against vertical shoulders 144, which permits vertical movement of plug insert 140 within second shell 120 against the spring bias of spring member 170. Alternatively, plug insert 140 could be secured forwardly of vertical lands 128 by stops such as rivets (similar to rivets 32 in receptacle connector 10) extending inwardly from the sides of second shell 120 in front of vertical shoulders 144.

Similarly to first connector 10, cable sleeve 190 is pushed into bore 132 of cable receiving section 134 of second shell 120 pinning shielding braid 118 against the tapered inner surface of bore 132 by the correspondingly tapered forward end 194 of sleeve 190. Retaining nut 192, when threaded onto correspondingly threaded cable receiving section 134, deflects strain relief section 196 of sleeve 190 firmly against and into outer jacket 116 of cable 112.

At the forward end of plug section 146 of plug insert 140, projection means comprising pairs of opposing lateral bosses 160 extend outwardly from sides 158 which will associate with channels 64 of receptacle insert 40 during mating. Atop the forward end of plug sectio 146 is a bearing means preferably comprising a rib 162 having a rounded bearing surface portion 164 and having a substantially rearwardly facing latching surface portion 166.

Figure 9A:
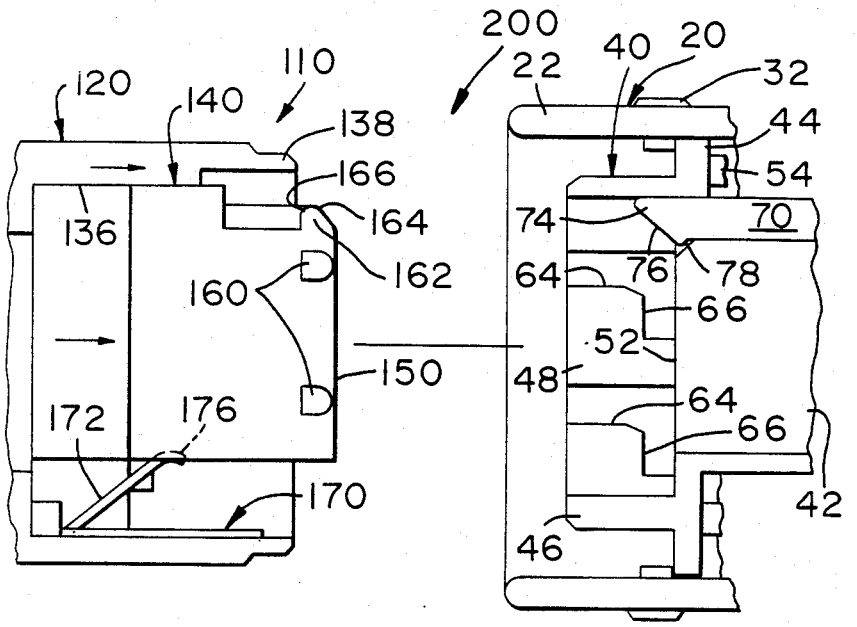
FIGS. 9A to 9E are diagrammatic illustrations of the mating and latching sequence of the first and second connectors of the present invention.
Figure 9B:
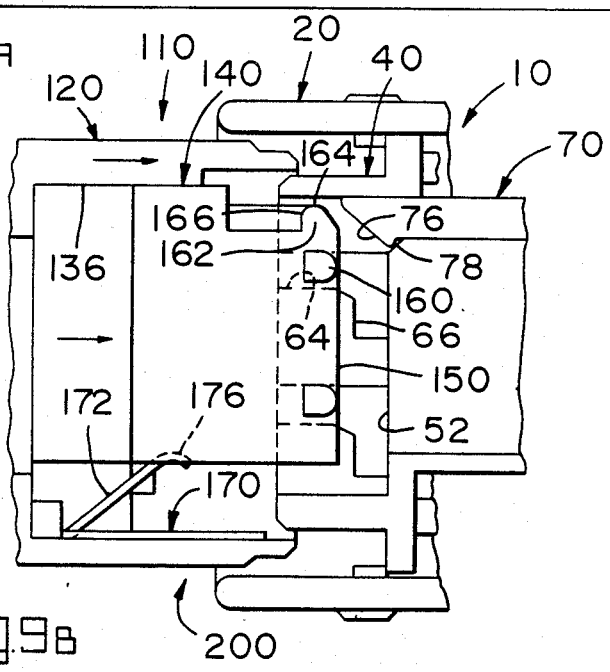

FIGS. 9A through 9E demonstrate the mating and latching sequence of second connector 110 with first connector 10 to form connector assembly 200, and the Figures are simplified for clarity. With connectors 10,110 being polarized to prevent mismating, plug section 146 of plug insert 140 is aligned to enter receptacle cavity 48 of receptacle insert 40 and lateral bosses 160 are aligned with axial portions of channels 64. Receptacle insert 40 is spring biased forwardly against stops 32, while plug insert 140 is spring biased by spring 170 upwardly against upper wall 136 of second shell 120. In FIG. 9B plug insert 140 enters receptacle insert 40 with bosses 160 entering channels 64. Front end 138 of second shell 120 enters inside front end 22 of first shell 20 around receptacle section 46 of receptacle insert 40, with both front end 138 of second shell 120 and receptacle section 46 preferably having chamfered outer front edges for lead-in benefits.

Figure 9C:
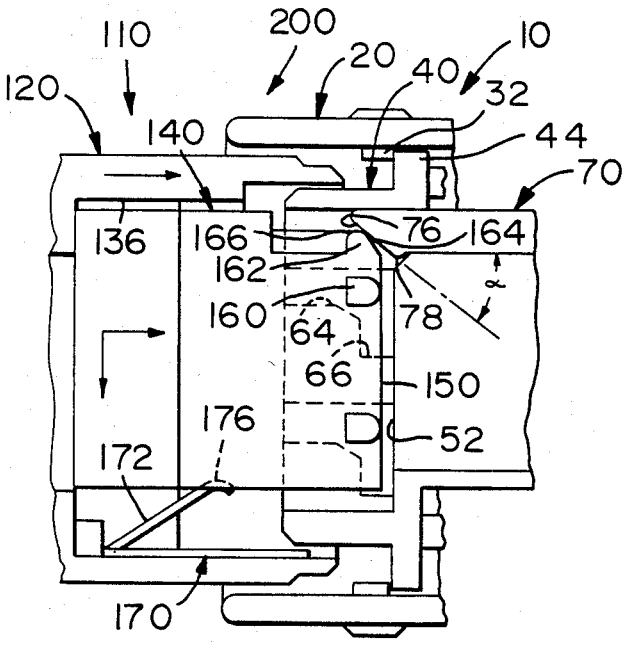

In FIG. 9C, plug insert 140 has been urged forwardly far enough into receptacle cavity 48 so that bosses 160 are vertically aligned with normal channel portions 66. Bearing surface 164 at the top of rib 162 of plug section 146 engages camming surface 76 on front end 74 of cam arm 70; and as plug insert 140 continues being urged axially forwardly, camming surface 76 bears against bearing surface 162 and urges plug insert 140 downwardly against spring arm 172 of spring member 170, with bosses 160 entering normal channel portions 66. Camming surface 76 of cam arm 70 is preferably at an angle $\alpha$ between about 25° and 35° from axial, and most preferably about 30°.

Figure 9D:
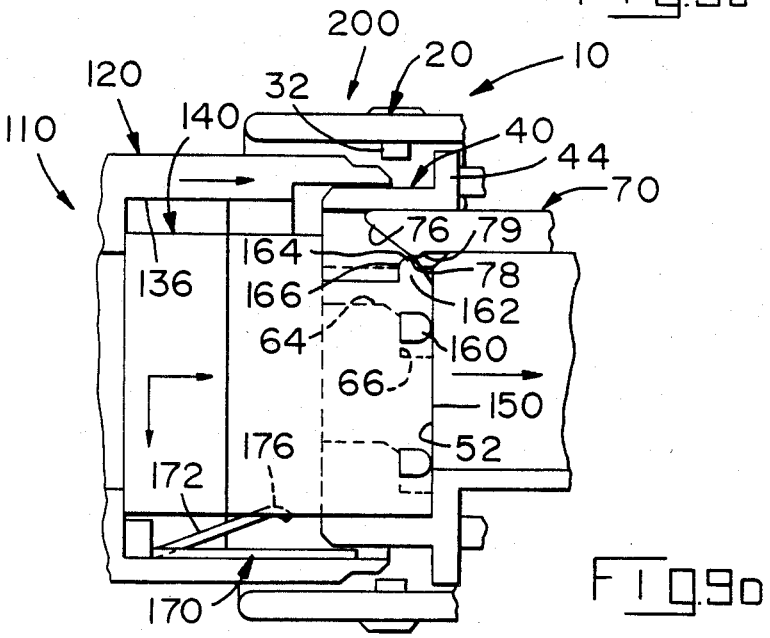
Figure 9E:
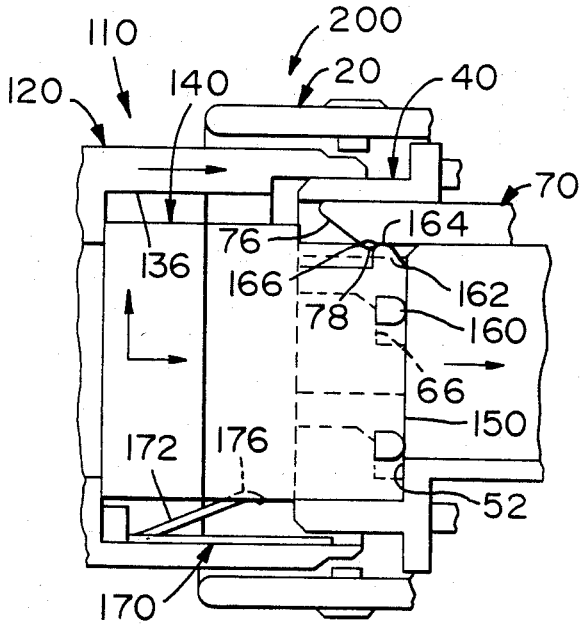

In FIG. 9D, when lateral bosses 160 are within normal channel portions 66 and plug insert mating face 150 is adjacent receptacle insert mating face 52, a tentative mating position has been achieved. It is tentative because the spring bias exerted by spring arm 170 against plug insert 140 renders the position shown in FIG. 9D mechanically unstable with a tendency to unmate. However, an electrically mated position has been reached because, as seen best in FIG. 11, full electrical engagement has been achieved between mating pairs of terminals 102,202 at contact sections 104,204. When plug insert 140 is urged still further axially forwardly, receptacle insert 40 is engaged and urged axially rearwardly thereby against the spring bias exerted by springs 56. When rounded short bearing surface 162 passes over latch ridge 78, plug insert 140 is urged upwardly by spring 170 and contact arms 104, and latching engagement occurs with rib 162 disposed behind latch ridge 78. FIG. 9E shows the fully mated and latched condition, with latching maintained by the combined spring forces of spring 170 and delfected contact arms 104.

Figure 10:
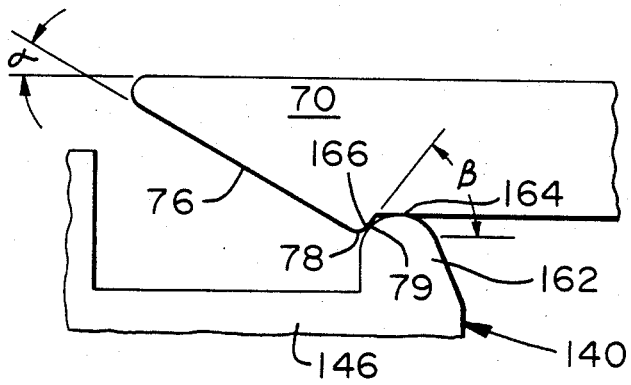
FIG. 10 is an enlargement of the limit latch system of the assembly.

The limit latch arrangement is shown enlarged in FIG. 10. The latching system required must generate more force in resistance to delatching than is generated by the axial spring bias from springs 56 plug possible low level axial force from jarring or inadvertent tugging occurring during in-service use; it must also be a sufficiently low force so that a reasonable amount of intentionally applied axial tensile force can overcome at once the resistance to delatching without tools or manipulation. Such a limit latch is provided based on spring 170, deflected contact arms 104, and the angle $\beta$ of very short rearward surface 79 of latch ridge 78, which is radiussed for wear resistance. Preferably the angle $\beta$ is from about 45° to 87° from axial, and most preferably its actual value is about 54°, but is dependent primarily on the spring force of spring 170: the higher the spring force thereof the more the surface 79 may be angled along the axial direction.

Figure 11:
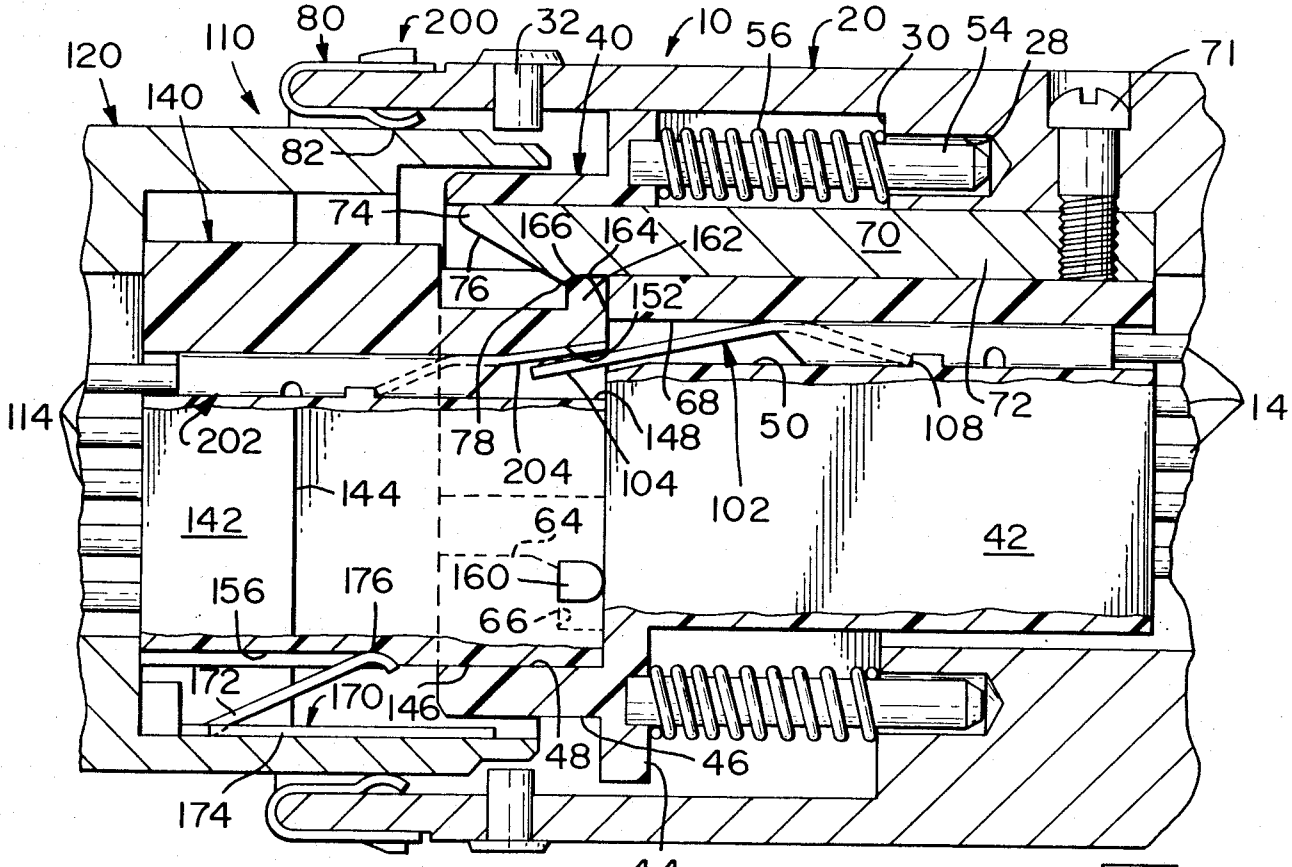
FIGS. 11 and 12 are elevation and top part longitudinal section views of the mated and latched connected assembly of the invention.
Figure 12:
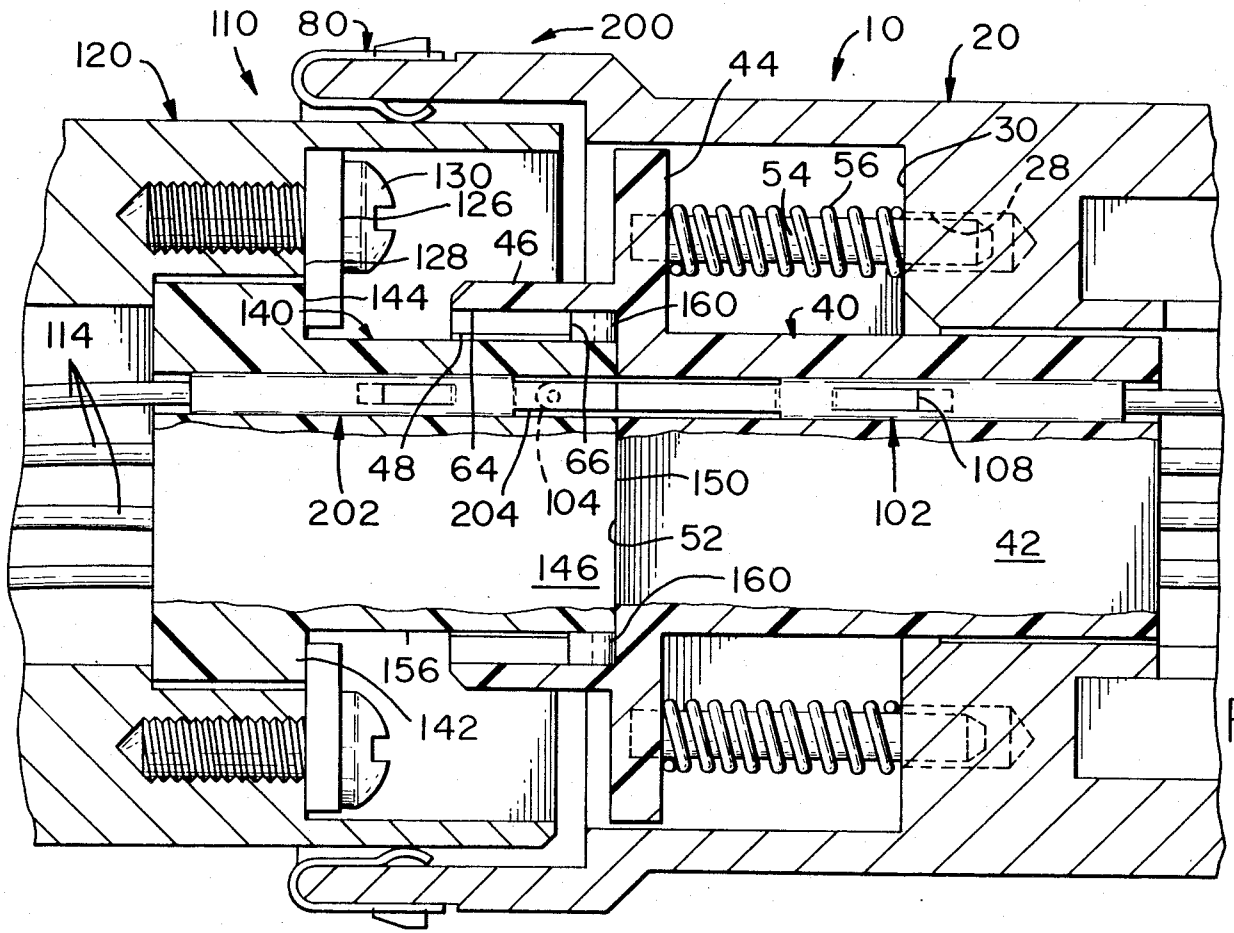

The operative portions of the mated and latched connector assembly 200 are shown in FIGS. 11 and 12. With reference to FIGS. 4 and 11, it can be seen that contact arms 104 of the receptacle's terminals 102 are engaged by contact sections 204 of the plug's terminals 202 when plug insert 140 is cammed downwardly by passive cam arm 70 and are deflected downwardly resulting in substantial contact normal force creating an assured electrical engagement therebetween. Terminal receiving passageways 50,148 are profiled to accommodate deflected contact arms 104 and the slight overtravel thereof just prior to latching. There is substantially no wear of the contact sections 104,204 during mating and unmating because there is no engagement therebetween prior to camming downwardly of plug insert 140: contact arms 104 of the receptacle's terminals 102 enter passageways 148 of plug insert 140 laterally spaced from contact sections 204. Additional camming movement produced by tapered camming surface 76 to overcome latch ridge 78 is kept to a minimum finite amount such as 0.015 inches to minimize overtravel and the risk of overstress of contact arms 104. It is also seen in FIGS. 11 and 12 that spring fingers 82 of EMI contact member 80 engage front end 138 of second shell 120 and are deflected slightly outwardly thereby, establishing a plurality of grounding engagement locations about the periphery of second shell 120.

Conductive first and second shells 20,120 are preferably metal such as cast aluminum by may be metallized plastic. Dielectric plug and receptacle inserts 140,40 are preferably molded of thermoplastic resin such as glass-filled polyester. Terminals 102,202 are preferably stamped and formed from resilient phosphor bronze copper alloy such as Copper Alloy 510 with gold over nickel plating over the contact portions. Stamped and formed EMI contact member 80 is preferably made of a resilient alloy such as nickel plated beryllium copper alloy. Cam arm 70 is preferably made of a rigid material such as aluminum having dry film lubricant such as graphite thereon for improved wear characteristics. Cable sleeves 90,190 are preferably brass and retaining nuts 92,192 are preferably made of aluminum. Coil springs 56 are preferably stainless steel and may for example each have a compression strength of one pound; stamped and formed spring member 170 is preferably made of stainless steel; and it may be desirable for springs 56,170 to be non-magnetizing.

Connector 200 is designed to be delatchable with a minimum of about six pounds and a maximum of about ten pounds tensile force, with ten pounds being preferred upon manufacture so that during repeated mating cycles of in-service use the requisite delatching tensile force may decline to about six pounds. Spring 170 is therefore preferred to have a nominal spring force of about six pounds. Additional normal spring force is generated by the plurality of deflected contact arms 104; for example, twenty contact pairs each at 150 grams normal force produce 3000 total grams or 6.6 pounds. The two forces together total 12.6 pounds axially normal force.

Figure 13:
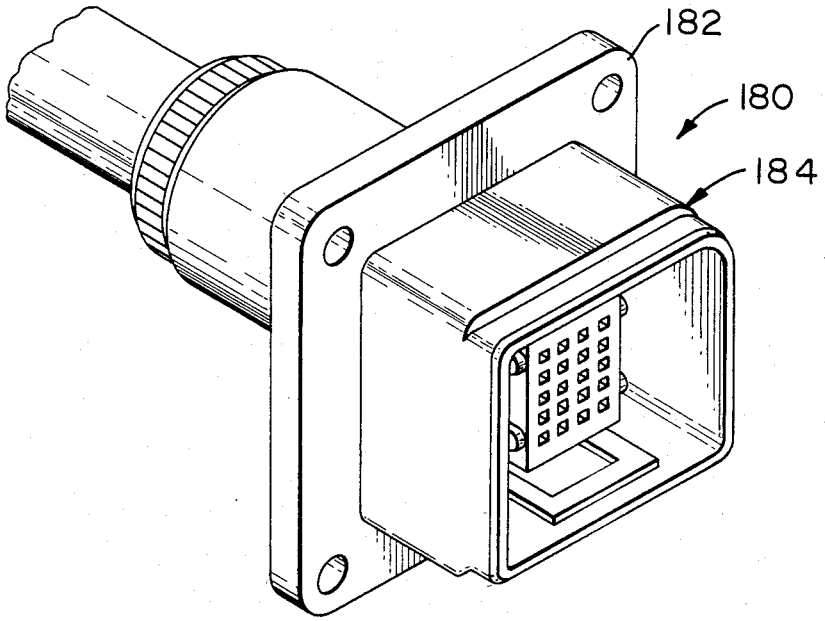
FIG. 13 is an alternate embodiment of the second connector with mounting flange.
Figure 14B:
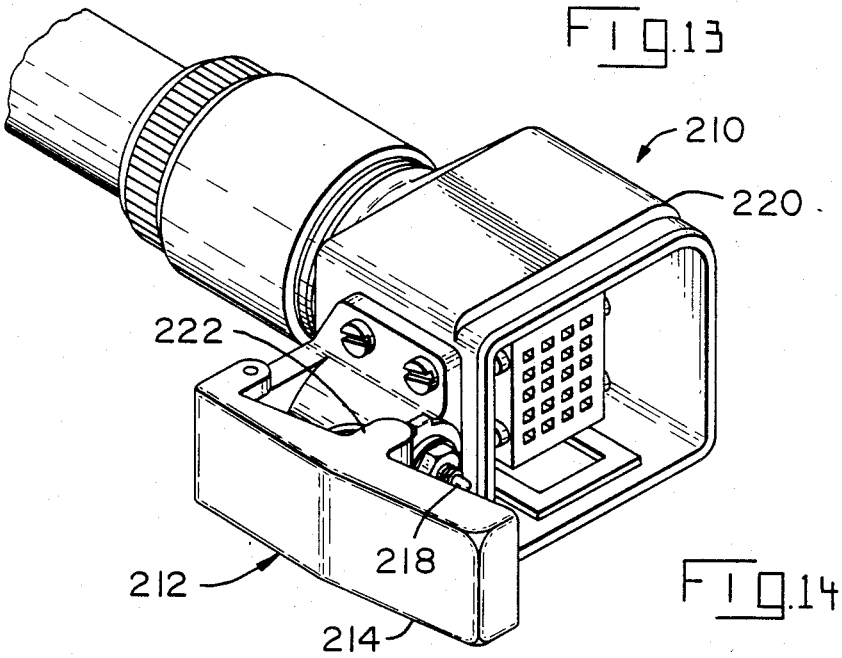
FIGS. 14A and 14B are an exploded and assembled view of another embodiment of the second connector with a switch.
Figure 14A:
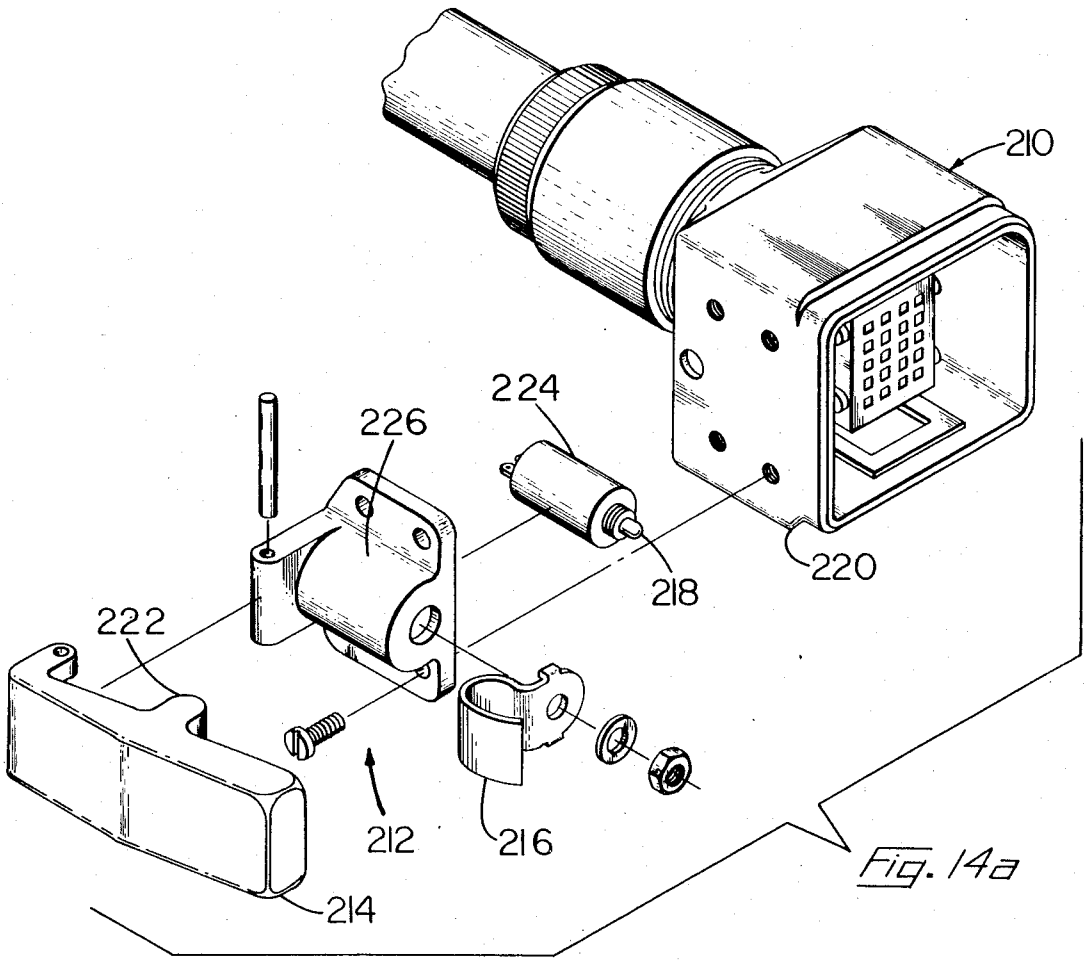

Ones of pairs of terminals 102,202 may be for ground and for power, but most will be for signal transmission between the helmet and the aircraft system. Regarding first or receptacle connector 10 one of cables 12 may carry conductors extending to the two earphones of the helmet while the other may extend to the microphone. In an alternate embodiment of second or plug connector 180, shown in FIG. 13, a flange 182 is provided on shell 184 by which connector 180 may be fixedly mounted to a panel. In another alternate embodiment of a plug connector, shown in FIGS. 14A and 14B, connector 210 has a switch assembly 212 mounted to the side of shell 220. Switch assembly 212 allows for instance, manual activation of the microphone of the helmet, with hand grip 214 being squeezable against the bias of spring 216 towards shell 220 to depress plunger 218 by cam 222 which actuates an electrical switch 224 in a housing 226 electrically connected to a relay in the aircraft system to activate the microphone.

The passive camming system and limit latch of the present invention also can be operable with the cam arm mounted on the second shell to be engaged by a bearing means on the receptacle insert, the cam arm and bearing means being respectively mounted on the opposite sides thereof from those in the disclosed embodiment. The plug insert would then be secured against axially normal movement, and a spring member would bias the receptacle insert against axially normal movement in a direction opposite to the selected direction in which plug insert 140 is movable in the disclosed embodiment. The same relative movement is obtained of the plug and receptacle inserts with respect to each other as in the disclosed embodiment.

Figure 15A:
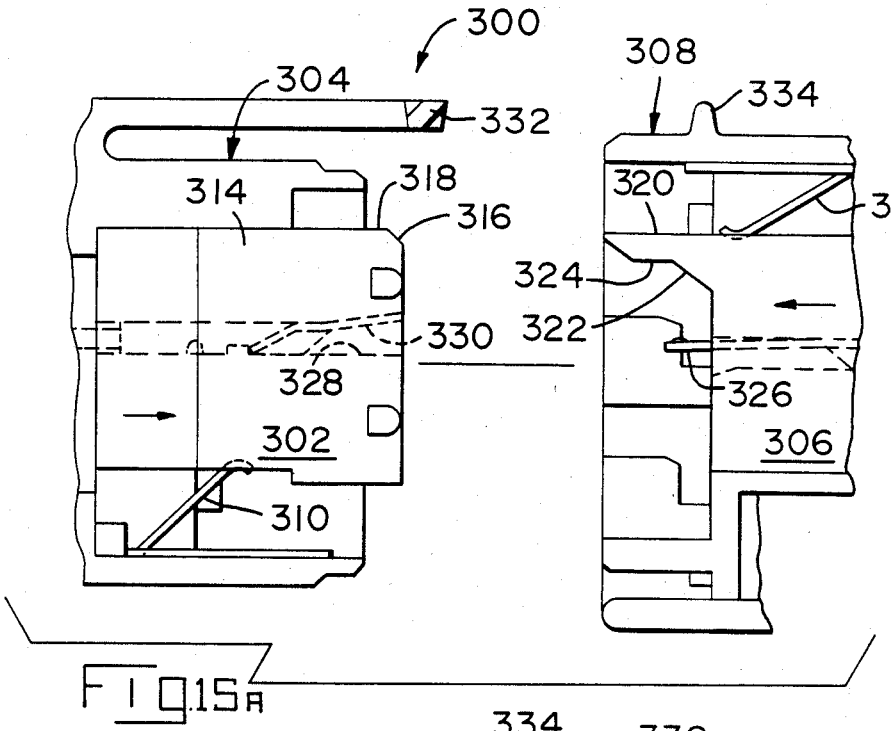
FIGS. 15A and 15B illustrate diagrammatically an alternative embodiment of the passive camming system of the present invention.
Figure 15B:
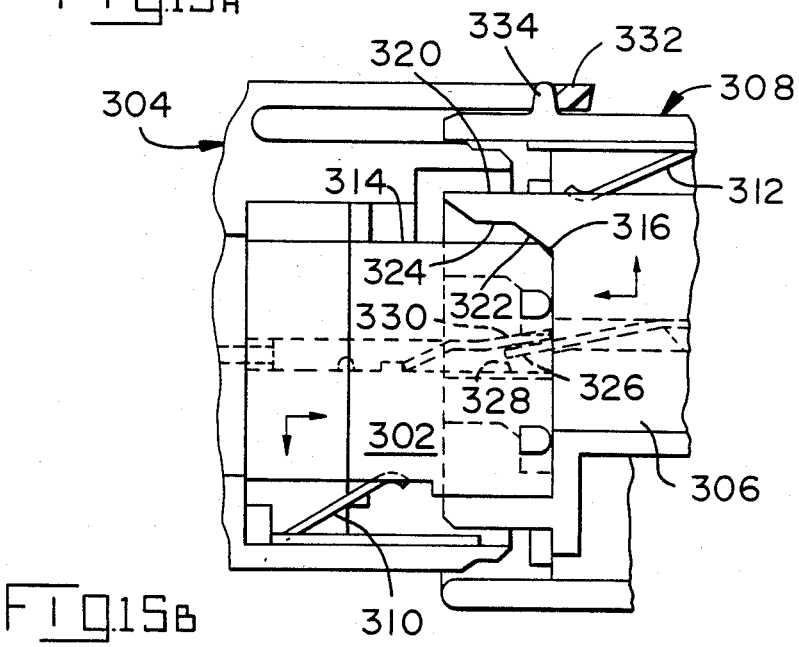

The passive camming of the present invention is useful where repeated mating/unmating cycles are desired to reduce wear on contact surfaces and yet provide for substantial contact normal force without a conventional zero insertion force (ZIF) cam means requiring separate manual or tool-assisted actuation. It may be desired to use the passive camming system by itself, without the limit latch disclosed herein, for improved wear characteristics. FIGS. 15A and 15B illustrate a connector 300 having plug insert 302 in plug shell 304, and receptacle insert 306 in receptacle shell 308. Both inserts 302, 306 are secured against axially rearward movement in respective shells 304,308 and are movable in opposing axially normal directions against respective normal springs 310,312. Plug section 314 of plug insert 302 has a bearing surface 316 along a selected side 318 thereof, and receptacle section 320 of receptacle insert 306 has a bearing surface 322 along the inside surface 324 thereof. After contact arms 326 enter passageways 328 beside contact portions 330, bearing surfaces 316,322 cooperatingly engage to cam both inserts 302,306 normally against respective springs 310,312 as contact arms 326 are deflected in the selected direction by corresponding contact portions 330. When full deflection has occurred, latching occurs by cooperating latch members 332,334 on shells 304,308 which are so positioned such as laterally from the respective insert mating faces to latch the shells after all camming within shall have completely occurred. Shells 304,308 may also be secured together by conventional fasteners.

The limit latch of the present invention is useful for a variety of multi-terminal connectors where delatching with axial tensile force is desired such as systems connectors for computers and data transmission apparatus, for portable keyboards for desktop computers, and for other apparatus.

Figure 16:
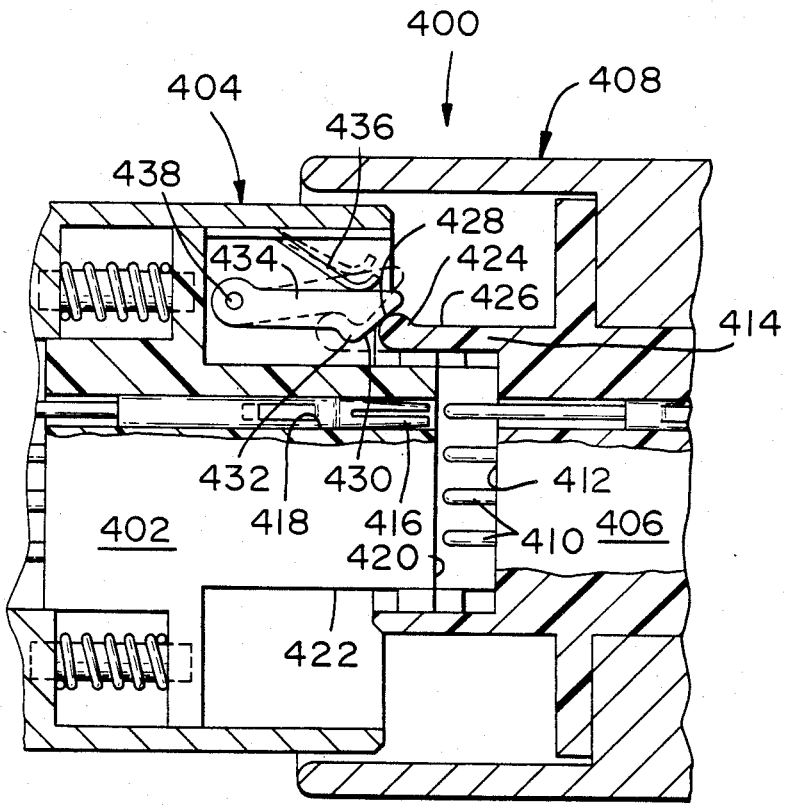
FIG. 16 illustrates an alternate embodiment of the latch system of the present invention.

The limit latch of the present invention can be operable with conventional contact mating actions, as illustrated in connector 400 in FIG. 16. Plug insert 402 is secured in plug shell 404 and receptacle insert 406 in receptacle shell 408. Pin contacts 410 extend forwardly from mating face 412 within receptacle section 414 of receptacle insert 406, while socket contacts 416 are secured within passageways 418 proximate mating face 420 of plug section 422 of plug insert 402. With plug insert 402 secured in shell 404 to permit axially rearward movement against spring bias, receptacle insert 406 pushes plug insert 402 rearwardly against spring bias after mating engagement of pins 410 in respective sockets 416. Latching projection 424 extends laterally from side 426 of receptacle insert 406 having bearing surface 428 which engages bearing surface 430 of latch member 432 secured within plug shell 404, with latch member 432 being on an arm 434 movable normally against spring bias of a spring 436 such as about a pivot 438. Latching projection 424 rides over latch member 432 and latches therebehind to hold connector 400 in a mated and latched arrangement. The geometry of the engaged surfaces of latches 424,432 is selected to permit delatching as in the embodiment illustrated in FIG. 10, upon the application of sufficient axial tensile force to overcome the bias of spring 436 and the combined frictional forces of pins 410 in sockets 416 resisting unmating thereof.

Other uses are foreseeable, and variations may occur to the particular embodiments shown without departing from the spirit of the invention and the scope of the claims.

What is claimed is:

1. An electrical connector assembly of a first connector and a second connector and instantaneously unmatable under limited axial unmating force, comprising:

first dielectric insert means having a receptacle section forwardly thereof and including a plurality of terminal-receiving passageways extending rearwardly from a first mating face, said passageways each having secured therein a first terminal terminated to a respective conductor, each said first terminal having a first contact section proximate said first mating face;

first shell means associated with said first insert means and including first means for mounting said first insert means therein adapted to permit limited axially rearward movement of said first insert means against first spring means;

second dielectric insert means having a plug section forwardly thereof and including a plurality of terminal-receiving passageways extending rearwardly from a second mating face, said passageways each having secured therein a second terminal terminated to a respective conductor, each said second terminal having a second contact section proximate said second mating face;

second shell means associated with said second insert means and including second means for mounting said second insert means therein adapted to permit limited movement of said second insert means against second spring means in a selected axially normal direction;

a forward section of said first shell means being adapted as a hood to receive thereinto a forward section of said second shell means, said first and second shell means having cooperating means for polarized mating;

said receptacle section of said first insert means being adapted to receive thereinto said plug section of said second insert means, said second contact sections being disposed within respective said passageways of said second insert means;

said first contact sections extending forwardly from said first mating face within said receptacle section of said first insert means and aligned with said passageways of said second insert means during mating to be received thereinto, and said first contact sections being adapted to be urgeable in said selected axially normal direction away from a selected receptacle side by said second contact sectios of said second insert means;

said first shell means having camming means secured thereto and associated with said selected side of said receptacle section of said first insert means, said camming means engageable by said second insert means upon polarized entry thereof into said receptacle section under axial force during mating to urge said second insert means in said selected axially normal direction against said second spring means to a tentative mating relationship with said first insert means and establishing assured contact normal force between said first and said second contact sections at least upon full mating;

a forward end of said plug section of said second insert means including latching means extending toward said camming means and latchable with a cooperating latching means of said camming means upon said second insert means engaging and urging rearwardly said first insert means after achieving said tentative mating relationship, said second insert means held in a latched position by said second spring means and thereby being latched in a fully mated relationship with said first insert means; and said latching means and said cooperating latching means being adapted such that said second insert means is delatchable from said first insert means and said first shell means upon application of a selected minimum axial tensile force applied to at least said first shell means and said second insert means to overcome the spring force applied by said second spring means and the resistance to delatching applied by said cooperating latching means, whereby said first and said second connectors are unmatable solely by said application of said selected minimum axial tensile force.

2. An electrical connector assembly as set forth in claim 1 wherein said receptacle section of said first insert means has channels along opposing inside surfaces of sidewalls normal to said selected receptacle side, said channels having axial portions beginning at a forward edge thereof and extending to portions extending normally to said axial portions away from said selected receptacle side, and said plug section of said second insert means having bosses extending laterally outwardly from the forward end thereof corresponding to said axial portions of said first insert means and receivable thereinto and therealong during mating, said bosses being latchable within said normal channel portions when said second insert means is urged in said selected direction against said second spring means by said camming means, achieving said tentative mating relationship with said first insert means.

3. An electrical connector assembly as set forth in claim 1 wherein said first mounting means includes means for retaining said first insert means in an axially aligned orientation during mating.

4. An electrical connector assembly as set forth in claim 1 wherein said first insert means is spring loaded axially forward against first stop means of said first shell means when unmated.

5. An electrical connector assembly as set forth in claim 1 wherein said second insert means is spring loaded in a direction opposed to said selected axially normal direction against second stop means of said second shell means when unmated.

6. An electrical connector assembly as set forth in claim 1 wherein said first contact sections comprise cantilever spring arms extending from respective said passageways of said first insert means proximate sides thereof nearest said selected receptacle side, and said second contact sections comprise arms tapered slightly toward a direction opposite from said selected axially normal direction and against sides of respective said passageways of said second insert means providing lead-ins for said first contact sections.

7. An electrical connector assembly as set forth in claim 1 wherein said first and second shell means are electrically conductive and a plurality of spring fingers are secured to the forward end of said first shell means and peripherally therearound extending rearwardly within said hood to engage under spring bias said forward end of said second shell means upon entry thereof into said first shell means during mating and establishing a plurality of shielding grounding locations with and substantially completely around said second shell means, providing EMI shielding.

8. An electrical connector assembly as set forth in claim 1 wherein said second shell means is secured to a panel by a lanyard.

9. An electrical connector assembly as set forth in claim 1 wherein said second shell means includes mounting flange means to enable mounting to a panel.

10. An electrical connector assembly as set forth in claim 1 wherein one of said first and second shell means includes switch means mounted to an outside surface thereof to be accessible for manual actuation, said switch means being electrically connected to at least one electrical conductor means within said one of said first and second shell means.

11. An electrical connector assembly as set forth in claim 1, wherein said camming means of said first shell means extends forwardly through a slot of and into said receptacle section of said first insert means and along the inside surface of a sidewall of said selected side thereof, and includes a camming surface facing forwardly and toward said selected axially normal direction.

12. An electrical connector assembly as set forth in claim 11, wherein said forward end of said plug section of said second insert means includes bearing means having cooperating bearing surface means engageable with said camming surface of said camming means and faces forwardly and outwardly from said forward end of said plug section.

13. An electrical connector assembly as set forth in claim 12 wherein said latching means is disposed rearwardly of said cooperating bearing surface means of said second insert means, and includes a substantially rearwardly facing latching surface means, and said cooperating latching means is disposed at the rearwardmost extent of said camming surface of said camming means and includes a substantially rearwardly facing surface, at least one of said latching surface and cooperating latching surface means having a selected small axially normal dimension and having a surface portion facing slightly in said selected axially normal direction.

14. An electrical connector assembly as set forth in claim 1, wherein said first shell means and said second shell means each further include respective strain relief means for respective cable means of said respective conductors.

15. An electrical connector assembly as set forth in claim 14, wherein said respective cable means are shielded and said respective strain relief means each include means for electrically connecting shielding means of said respective cable means respectively to said first shell means and said second shell means.

16. An electrical connector assembly of a first connector and a second connector and instantaneously delatchable under limited axial tensile force, comprising:

first dielectric insert means having a receptacle section forwardly thereof and including a plurality of terminal receiving passageways extending rearwardly from a first mating face, said passageways each having secured therein a first terminal terminated to a respective conductor, each said first terminal having a first contact section proximate said first mating face;

first shell means associated with said first insert means and including first means for mounting said first insert means therein;

second dielectric insert means having a plug section forwardly thereof and including a plurality of terminal receiving passageways extending rearwardly from a second mating face, said passageways each having secured therein a second terminal terminated to a respective conductor, each said second terminal having a second contact section proximate said second mating face;

second shell means associated with said second insert means and including second means for mounting said second insert means therein;

a forward section of said first shell means being adapted as a hood to receive thereinto a forward section of said second shell means, said first and second shell means having cooperating means for polarized mating, said receptacle section of said first insert means being adapted to receive thereinto said plug section of said second insert means, and said first and second contact sections being adapted to electrically engage each other during mating;

one of said first and said second shell means having camming means secured thereto and associated with a selected side of a corresponding one of said first and said second insert means, said camming means engageable by bearing means of the other of said first and said second insert means at least after achievement of a tentative mating relationship between said first and said second insert means to move at least said other of said first and said second insert means in a selected axially normal direction with respect to said one of said first and second shell means and against normal spring means;

said other of said first and said second insert means including latching means extending toward said camming means and latchable with a cooperating latching means of said camming means upon said other of said first and said second insert means engaging and urging rearwardly said one of said first and said second insert means against axial spring means after achieving said tentative mating relationship, said other of said first and said second insert means held in a latched position by said normal spring means and thereby being latched in a fully mated relationship with said one of said first and said second insert means; and said latching means and said cooperating latching means having respective latching surface means adapted to allow relative movement therealong in an unmating direction such that said other of said first and said second insert means is delatchable from said one of said first and said second insert means and said one of said first and said second shell means upon application of a selected axial tensile force applied to at least said one of said first and said second shell means and said other of said first and said second insert means to overcome the spring force applied by said normal spring means and the resistance to delatching applied by said cooperating latching means, whereby said first and said second connectors are unmatable solely by said application of said selected axial tensile force.

17. An electrical connector assembly as set forth in claim 16 wherein said axial spring means is secured in said first shell means to bias said first insert means against axial rearward movement, said first shell is adapted to permit axial rearward movement of said first insert means therein, said normal spring means is secured in said second shell means to bias said second insert means against movement in said selected axially normal direction, said second shell means is adapted to permit movement of said second insert means therein, said camming means is secured to said first shell means along a selected side of said hood means of said first shell means, said bearing means is disposed at a forward end of said plug sectio of said second insert means, said second insert means is urged in said selected direction by engagement of said bearing means with said camming means to a said tentative mating relationship, said second insert means engages and urges rearwardly said first insert means, and said latching means is disposed on said second insert means and latches behind said cooperating latching means on said camming means latching said first and second insert means in said fully mated relationship, and said second insert means is delatchable from said first shell means solely by application of said selected axial tensile force thereto.

18. An electrical connector assembly as set forth in claim 16 wherein said cooperating latching means comprises a very short surface facing rearwardly at an angle of between about 50° to about 87° from axial.

19. An electrical connector assembly of a plug connector and a receptacle connector each having a plurality of matable contact terminal means terminated to respective electrical conductor means and each including a dielectric housing and an outer shell, wherein (A) said receptacle connector comprises:

dielectric receptacle housing means having a first mating face and a plurality of terminal receiving passageways therethrough and further having receptacle section means extending forwardly from the periphery of said first mating face defining a plug receiving cavity;

a like pluraity of first contact terminal means terminated to respective first conductor means and secured in respective said terminal receiving passageways of said receptacle housing means, each said first contact terminal means including a cantilever spring arm forward portion extending forwardly of said first mating face within said receptacle section means and adapted to be deflected in a common selected axially normal direction, a respective contact portion of each said first contact terminal means being disposed on a surface of said forward portion forwardly of said first mating face and facing the opposite direction from said selected direction; and first shell means having said receptacle housing means secured therewithin by first securing means and having strain relief means for said first conductor means; and (B) said plug connector comprises:

dielectric plug housing means having a second mating face along a forward surface of a plug section and having a plurality of terminal receiving passageways therethrough;

a like plurality of second contact terminal means terminated to respective second conductor means and secured in respective said terminal receiving passageways of said plug housing, said second contact terminal means having contact portions proximate said second mating face and disposed along a common selected side of respective said terminal receiving passageways and substantially therewithin; and second shells means having said plug housing means secured therewithin by second securing means and having strain relief means for said second conductor means;

(C) wherein:

said first and second shell means include cooperating polarizing means for polarized axial mating prior to said receptacle and plug housing means beginning to engage for mating;

said receptacle section means is adapted to receive said plug section thereinto in an aligned orientation such that said forward portions of said first contact terminal means freely enter corresponding said terminal receiving passageways of said plug section to be disposed along said contact portions of said second contact terminal means, and said receptacle section means is further adapted to permit limited relative movement of said plug section therewithin in said selected direction;

at least one of said plug connector and said receptacle connector includes spring means biasing a respective at least one of said plug housing means and said receptacle housing means against movement in said selected axially normal direction or the opposite direction respectively, and a respective at least one of said first and second securing means are adapted to permit limited movement of said at least one of said plug housing means and said receptacle housing means in said selected or said opposite direction respectively;

cooperating passive camming means and bearing means are disposed on a respective one and another of said plug and said receptacle connector at respective locations thereon selected such that said camming and bearing means engage each other during mating when said first and second mating faces are substantially adjacent each other, and said camming and bearing means are adapted to urge said at least one of said plug housing means and said receptacle housing means in said selected or said opposite direction respectively, with said plug housing means relatively moving in said selected direction with respect to said receptacle housing means; and cooperating latching means are disposed on said plug and receptacle connectors and are adapted to latch when said plug housing means and said receptacle housing means are fully mated, whereby when said first and second mating faces are substantially adjacent each other during mating, said forward portions of said first contact terminal means have entered corresponding said terminal receiving passageways of said plug housing means adjacent said contact portions of respective said second contact terminal means, and said cooperating camming and bearing means engage and cooperate to urge said at least one of said plug housing means and said receptacle housing means in said selected or said opposite direction respectively against spring bias and biasing said forward first terminal portions relatively against said second terminal contact portions into electrical engagement therewith whereupon said first and second connectors latch together in fully mated engagement.

20. An electrical connector assembly as set forth in claim 19 wherein said at least one of said plug connector and said receptacle connector is said plug connector, and said receptacle housing means is secured against movement in said opposite direction.

21. An electrical connector assembly as set forth in claim 19 wherein channel means extend axially rearwardly from a forward end to a rearward end of one of said plug section and said receptacle section means along opposing side surfaces thereof and include portions extending axially normally proximate the respective said rearward end thereof, and cooperating projection means are disposed on the other of said plug section and said receptacle section means adjacent a forward end thereof and are aligned with respective said channel means prior to engagement of said plug housing means and said receptacle housing means, said projection means being adapted to enter said normal channel portions when said first and second mating faces are substantially adjacent each other prior to engagement of said cooperating camming means, and said projection means enter said normal channel portions upon said relative axially normal movement of said receptacle housing means and said plug housing means.

22. An electrical connector assembly as set forth in claim 21 wherein said channel means are disposed along opposing inside side surfaces of said receptacle section means and said cooperating projection means are disposed along opposing outside side surfaces of said plug section.

23. An electrical connector assembly as set forth in claim 19 wherein said passive camming means comprises a tapered bearing surface selectively disposed to relatively urge said plug housing means in said selected direction.

24. An electrical connector assembly as set forth in claim 23 wherein said receptacle connector includes said tapered bearing surface facing forwardly and towards said selected direction within said plug receiving cavity along a wall opposed from said selected direction, and said plug housing means includes said bearing means at a forward end of said plug section thereof along an outer surface opposed from said selected direction and engageable with said tapered bearing surface.

25. An electrical connector assembly as set forth in claim 23 wherein said tapered bearing surface is disposed at an angle of between 25° and 55° from axial.

* * * * *